US005722871A

United States Patent [19]

Zamir

[11] Patent Number: 5,722,871

[45] Date of Patent: Mar. 3, 1998

[54] VARIABLE BOUYANCY AMUSEMENT DEVICE

[76] Inventor: Amos Zamir, 3 Hasvoraim, Tel Aviv 69207, Israel

[21] Appl. No.: 694,512

[22] Filed: Aug. 9, 1996

[51] Int. Cl.[6] ..... A63H 23/00

[52] U.S. Cl. ..... 446/153

[58] Field of Search ..... 446/153, 155, 446/156, 159, 161, 267

[56] References Cited

U.S. PATENT DOCUMENTS

| | | | |
|---|---|---|---|
| 449,748 | 4/1891 | Roberts . | |
| 459,868 | 10/1891 | Law . | |
| 479,530 | 8/1892 | Roberts . | |
| 1,736,270 | 11/1929 | Mackintosh | 446/161 |
| 2,708,810 | 5/1955 | Canto et al. | 446/161 |
| 2,791,062 | 5/1957 | Hirch et al. . | |
| 3,009,286 | 11/1961 | Warner . | |
| 3,010,251 | 11/1961 | Derdowski | 446/155 |
| 3,451,159 | 6/1969 | Springfors | 446/161 |
| 3,695,607 | 10/1972 | Stouffer . | |
| 5,256,457 | 10/1993 | Pantaleo . | |

FOREIGN PATENT DOCUMENTS

| | | | |
|---|---|---|---|
| 926406 | 10/1947 | France | 446/161 |
| 16732 | of 1910 | United Kingdom | 446/153 |
| 559254 | 2/1944 | United Kingdom | 446/156 |
| 658070 | 10/1951 | United Kingdom | 446/155 |
| 91/19657 | 7/1991 | WIPO | 446/153 |

*Primary Examiner*—D. Neal Muir
*Attorney, Agent, or Firm*—Mark M. Friedman

[57] ABSTRACT

A variable buoyancy amusement device for use in water includes a body having a water-impermeable outer surface and an internal volume. A relatively heavy lower portion of the body has a local density significantly greater than that of water so that the body tends to assume an upright orientation with the lower portion at the underside of the body. The body also features an internal cavity connected to the surface of the body by an upper aperture and a lower aperture. At least one of the apertures is selectively closeable so that, when the cavity contains air, the body floats on the water with the lower aperture submerged. When the aperture is opened, water enters the cavity through the lower aperture thereby reducing the buoyancy of the body and causing it to sink.

9 Claims, 3 Drawing Sheets

VARIABLE BOUYANCY AMUSEMENT DEVICE

FIELD AND BACKGROUND OF THE INVENTION

The present invention relates to a variable buoyancy amusement device.

It is known to provide various amusement devices for use in water. Of particular importance are children's toys suitable for use in the bath. Such toys provide a valuable tool for entertaining children at bath-time.

Conventionally, bath toys have been limited to fixed buoyancy devices epitomized by the proverbial rubber duck. Although the aesthetics of bath toy designs varies greatly, the buoyancy of each design remains essentially fixed.

There is therefore a need for a simple, robust, variable buoyancy amusement device.

SUMMARY OF THE INVENTION

The present invention is of a variable buoyancy amusement device.

According to the teachings of the present invention there is provided, a variable buoyancy amusement device for use in water, the device comprising a body having a water-impermeable outer surface and an internal volume, the body including: (a) a lower portion having a local density significantly greater than that of water such that the body tends to assume an upright orientation with the lower portion at the underside of the body; (b) an internal cavity having an upper part and a lower part defined by their positions when the body assumes its upright orientation; (c)an upper aperture connecting between the upper part of the cavity and an adjacent location on the surface; and (d) a lower aperture connecting between the lower part of the cavity and an adjacent location on the surface, wherein at least one of the apertures is selectively closeable such that, when the cavity contains air and the selectively closeable aperture is closed, the body floats on the water with the lower aperture submerged and, when the selectively closeable aperture is opened, water enters the cavity through the lower aperture thereby reducing the buoyancy of the body and causing it to sink.

According to a further feature of the present invention, the body further includes a light upper portion having a local density significantly less than that of water such that the body is self-righting to the upright orientation when submerged.

According to a further feature of the present invention, the selectively closeable aperture is implemented as a shaped aperture with a complementary plug.

According to a further feature of the present invention, the two apertures are implemented as similarly-shaped apertures such that the complementary plug may be employed selectively to close either of the apertures.

According to a further feature of the present invention, there is also provided an input tube having a first end adapted for sealable connection to one of the upper and lower apertures for introducing air into the cavity.

According to a further feature of the present invention, the lower portion provides a substantially flat resting surface for the body.

According to a further feature of the present invention, the body is implemented in the form of a doll.

According to a further feature of the present invention, there is also provided: (a) a float located within the cavity; (b) at least one member associated with the body, the member being deployable from a first position to a second position, the member being externally visible in at least the second position; and (c) a mechanical linkage linking between the float and the member such that movement of the float caused by filling of the cavity with water actuates deployment of the member from the first position to the second position.

According to a further feature of the present invention, the at least one member includes a pop-up sign.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is of a variable buoyancy amusement device.

The principles and operation of a device according to the present invention may be better understood with reference to the drawings and the accompanying description.

Figure 1:
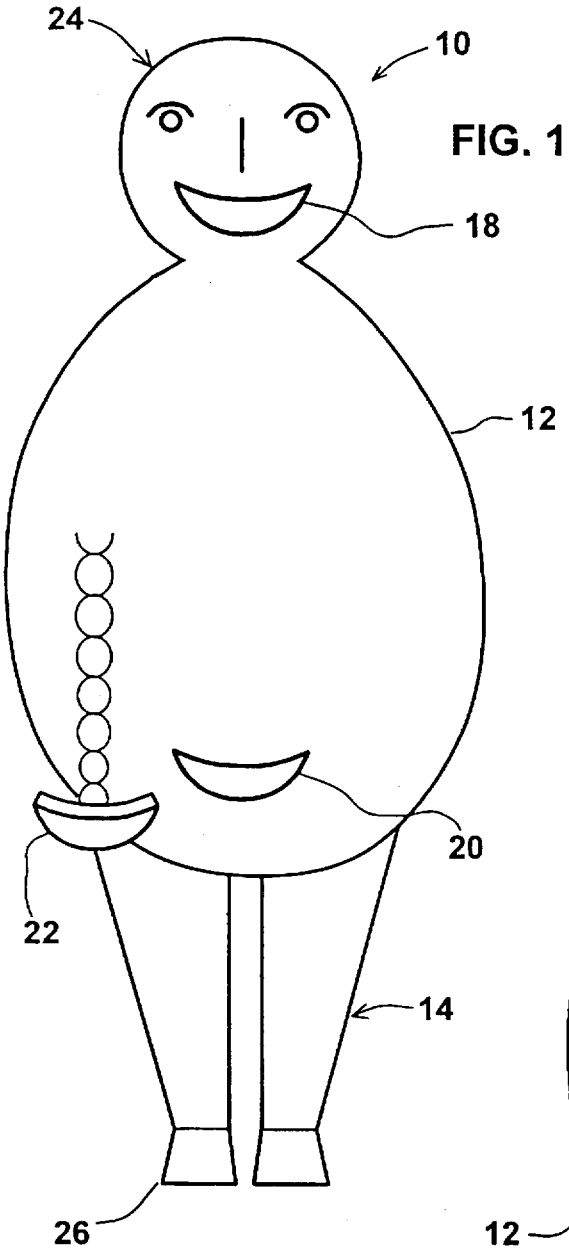
FIG. 1 is a schematic front view of a basic embodiment of a variable buoyancy amusement device, constructed and operative according to the teachings of the present invention.
Figure 2:
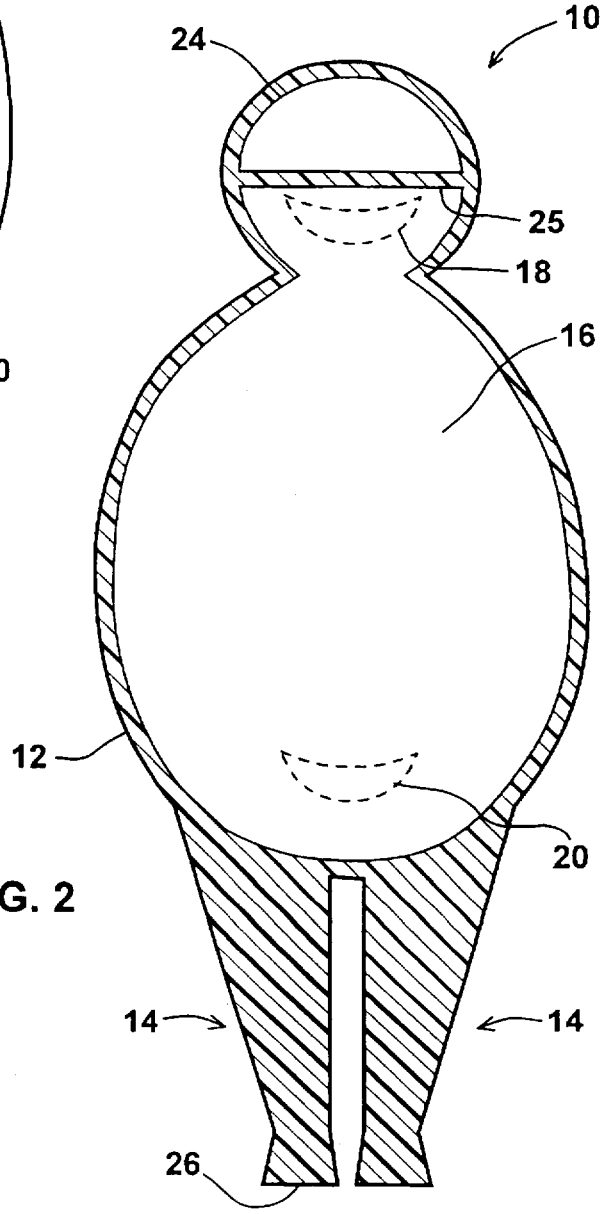
FIG. 2 is a schematic vertical cross-sectional view through the device of FIG. 1.
Figure 3:
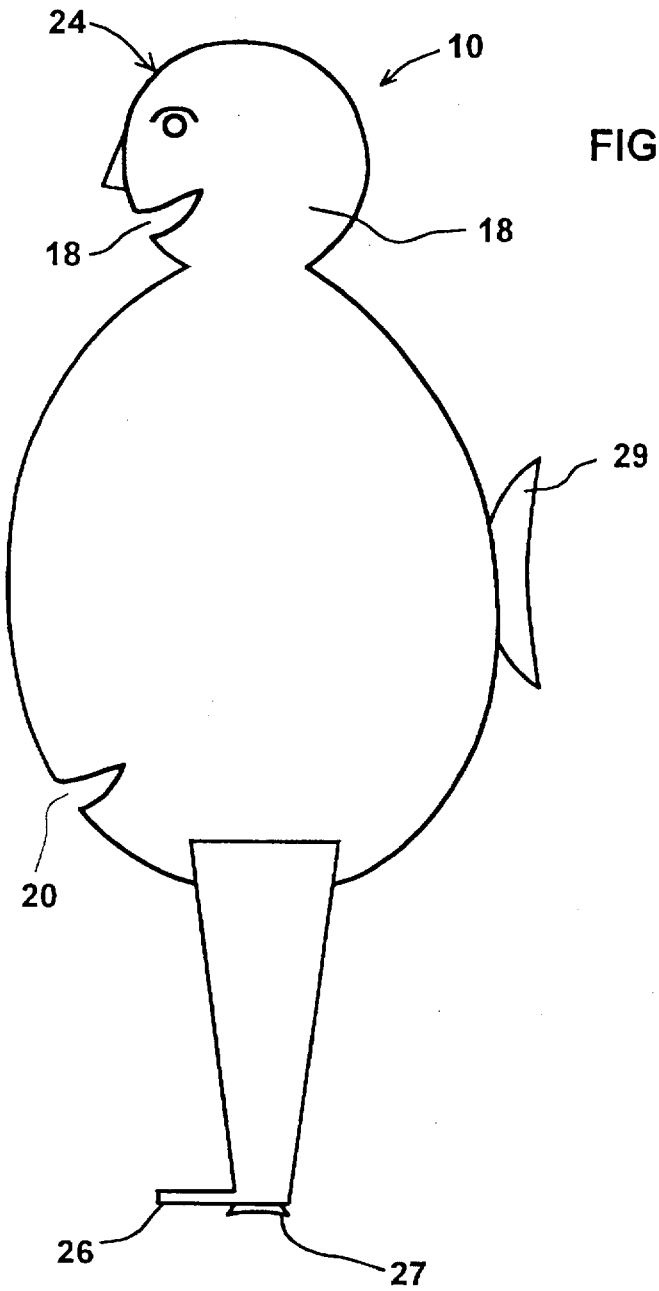
FIG. 3 is a schematic side view of the device of FIG. 1.

Referring now to the drawings, FIGS. 1–3 show a basic embodiment of a variable buoyancy amusement device, generally designated 10, constructed and operative according to the teachings of the present invention. Generally speaking, device 10 includes a body 12 having a water-impermeable outer surface and an internal volume. Body 12 includes a relatively heavy lower portion 14 which has a local density significantly greater than that of water. This ensures that body 12 tends to assume an upright orientation with lower portion 14 at the underside of body 12. Body 12 also features an internal cavity 16 which is connected through an upper aperture 18 and a lower aperture 20 to the surface of body 12. Upper aperture 18 connects from near the top of cavity 16 to a corresponding point on the surface of body 12, and lower aperture 20 connects from near the bottom of cavity 16 to a corresponding point on the surface of body 12. At least one of the apertures is selectively closeable, as will be described in more detail below.

Although shown here, by way of example, in the form of a doll, it should be appreciated that device 10 may be implemented in a wide variety of different shapes and designs. Examples include, but are not limited to, human and animal figures of all kinds, boats, submarines, and all other types of marine and non-marine vehicles.

When cavity 16 contains air and lower aperture 20 is closed, body 12 floats on the water with lower aperture 20 submerged. When lower aperture 20 is opened, it allows water to enter cavity 16 displacing the air through upper aperture 18, thereby reducing the buoyancy of body 12 until it sinks.

Preferably, both upper aperture 18 and lower aperture 20 are ornamentally shaped apertures, and selective closing of one or other of the apertures may be achieved simply by insertion of a complementary shaped plug 22. Plug 22 is typically attached to body 12 by a string, light chain, or other flexible connection to prevent it from being swallowed or lost. Alternatively, one or both of the apertures may include a simple switchable valve. Each of apertures 18 and 20 preferably has an area of between about 0.25 and about 4 $cm^2$ and typically about 1 $cm^2$ The orientation of the apertures is such that, when body 12 assumes its upright position, apertures 18 and 20 face laterally.

Body 12 is preferably constructed so as to maintain a given upright orientation whether floating or submerged. This is achieved by a combination of relatively heavy lower portion 14 with a light upper portion 24. Lower portion 14 may be implemented as a portion of device 10 formed from solid rubber or other relatively heavy material from which the device is formed. Alternatively, lower portion 14 may contain one or more weights for this purpose. Preferably, lower portion 14 provides a substantially flat resting surface 26 for body 12 which helps device 10 remain steady when resting on a surface, both when submerged and when not in use.

Light upper portion 24 has a local density significantly less than that of water such that body 12 is self-righting to its upright orientation when submerged. Upper portion 24 may be implemented as a thin wall or partition 25 across the top of cavity 16, thereby forming a pocket of trapped air which remains even when cavity 16 is water-filled. In an alternative embodiment, light upper portion may contain one or more buoyant insert.

FIG. 3 illustrates an optional provision of suction cups in device 10. Specifically, a rear suction cup 29 may be provided on the rear surface of device 10. Rear suction cup 25 provides a convenient means of securing device 10 to any smooth surface such as, for example, the side of a bath or a tiled wall. This allows convenient storage for the device while not in use.

A further, or alternative, enhancement may be provided by a small suction cup 27, typically attached to the underside of surface 26. Obviously, small suction cup 27 may help to maintain device 10 in an upright standing position when standing out of the water. More significantly, however, it serves additional recreational functions. Small suction cup 27 provides sufficient suction to allow device 10 in its buoyant state to be temporarily attached to a submerged surface. After a brief delay, the buoyancy of device 10 overcomes the suction effect such that device 10 frees itself, shooting rapidly upwards.

The reliability of this "timed-release" effect may be improved by forming a slightly larger suction cup 27 with a small perforation or "leak". This ensures both that the initial suction is sufficient to hold device 10 submerged, and that it will release itself within a fairly short interval.

It should be appreciated that device 10 typically remains buoyant when held submerged while either one of its apertures is closed. In the case that upper aperture 18 is closed and lower aperture 20 is open, almost all the air within cavity 16 is trapped. In the case that lower aperture 20 is closed and upper aperture 18 is open, the behavior while submerged depends on the design of upper aperture 18, namely, its size and shape, and the thickness of the wall of body 12. If the aperture is sufficiently small, and the wall sufficiently thick, air cannot be released while water simultaneously or alternately enters, thereby preventing filling of cavity 16 with water. The design of upper aperture 18 is preferably chosen such that minimal leakage occurs as long as lower aperture 20 is closed.

Conversely, when body 12 is removed from the water with cavity 16 water-filled and upper aperture 18 sealed, water is generally not released from lower aperture 20 due to a vacuum effect.

Figure 4:
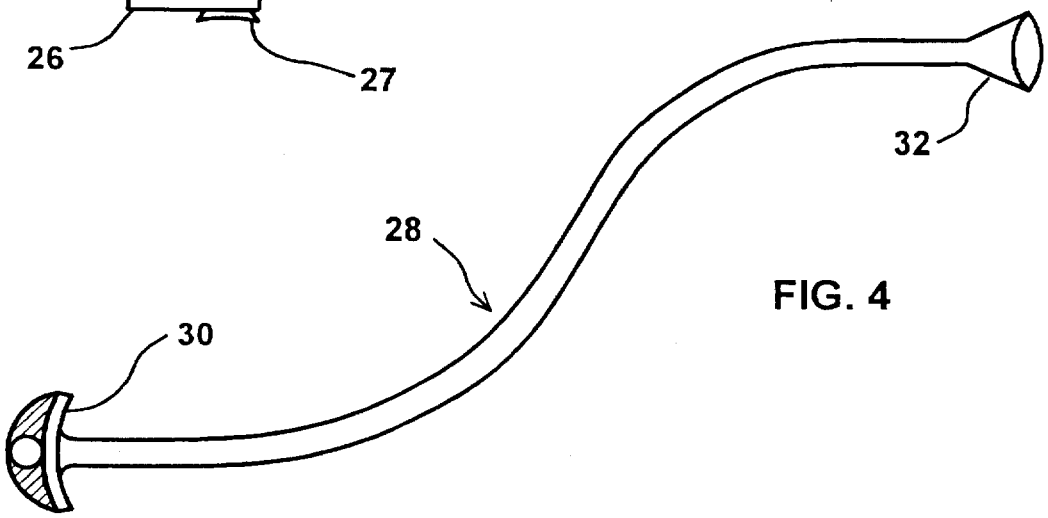
FIG. 4 is a schematic representation of an input tube for use with the device of FIG. 1.

Turning now to FIG. 4, this shows an input tube 28 for introducing air into cavity 16 while body 12 is submerged. Input tube 28 has at one end a connector 30 shaped so as to mate with either upper aperture 18 or lower aperture 20. The second end of input tube 28 preferably features a mouthpiece 32.

It is preferable that a number of precautions are taken against dangerous misuse of input tube 28. These may include using rigid or semi-rigid plastic materials to prevent risk of strangulation. In this case, a section of input tube 28 near connector 30 is preferably made from flexible material so as not to restrict the self-righting of body 12. A non-return valve of various types may be included in the tube, and connector 30 may be made sufficiently large and irregularly shaped to discourage a child from placing it in his mouth. This latter combination of features helps to prevent any inadvertent inhalation of water.

The operation of device 10 is as follows. In an initial state in which cavity 16 contains air and lower aperture 20 is closed by plug 22, body 12 floats upright in water with lower aperture 20 submerged and upper aperture 18 above the water. When lower aperture 20 is opened, water begins to enter cavity 16, displacing the air through upper aperture 18. As cavity 16 fills, the overall buoyancy of body 12 decreases until body 12 begins to sink. The remainder of the air being released is seen as bubbles escaping from upper aperture 18.

Subsequently, input tube 28 may be connected to either upper aperture 18 or lower aperture 20. In the latter case, air blown through input tube 28 passes up through cavity 16 and emerges as bubbles from upper aperture 18. In the former case, air blown through input tube 28 starts to displace water from cavity 16 out through lower aperture 18, thereby increasing the buoyancy of body 12. By controlling the amount of air input through input tube 28 it is possible to adjust the buoyancy to a required level. This level can then be temporarily fixed by covering the end of input tube 28.

It is important to note that the variable buoyancy described herein, together with the possibility of fixing the buoyancy at any required level, provides a highly controllable variable-buoyancy device with almost unlimited recreational potential.

It should be noted that the density distribution within body 12 is such that body 12 remains upright at all times, whether floating, partially submerged or fully submerged. Specifically, relatively heavy lower portion 14 maintains the upright orientation while body 12 is floating, even if a major part of body 12 is above the water level. When submerged, light upper portion 24 is highly effective for maintaining the orientation by providing localized buoyancy to pull the upper part of body 12 upwards. This results in a rapid self-righting movement when body 12 is released from a tilted or inverted position.

Figure 5:
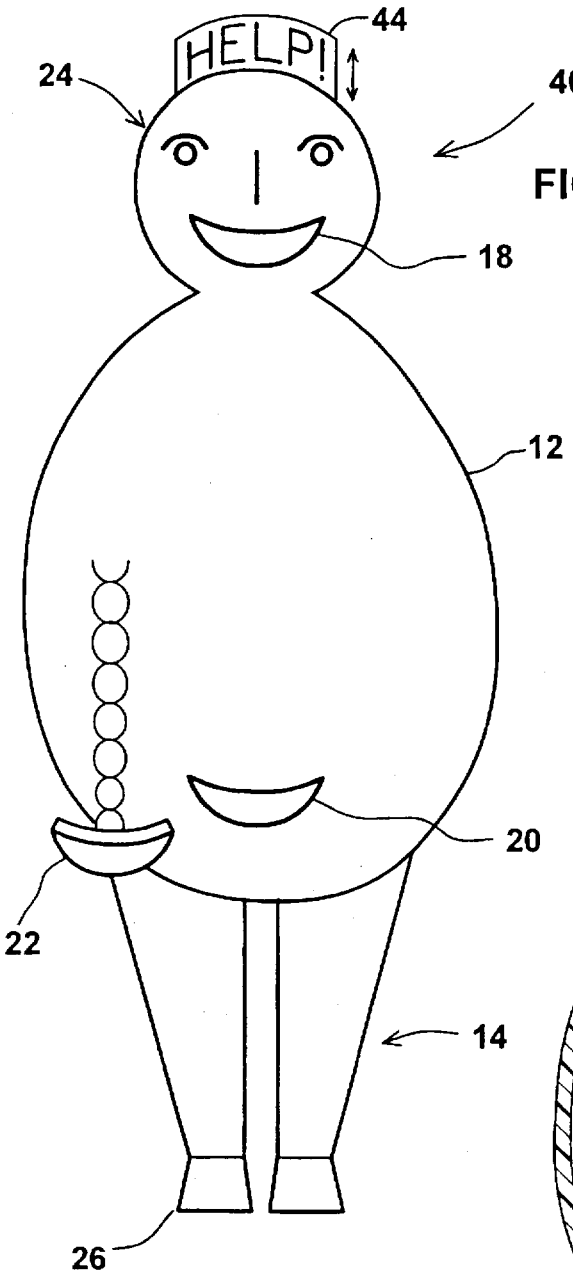
FIG. 5 is a schematic front view of a preferred embodiment of a variable buoyancy amusement device illustrating a deployable member in its deployed position, the device being constructed and operative according to the teachings of the present invention.
Figure 6:
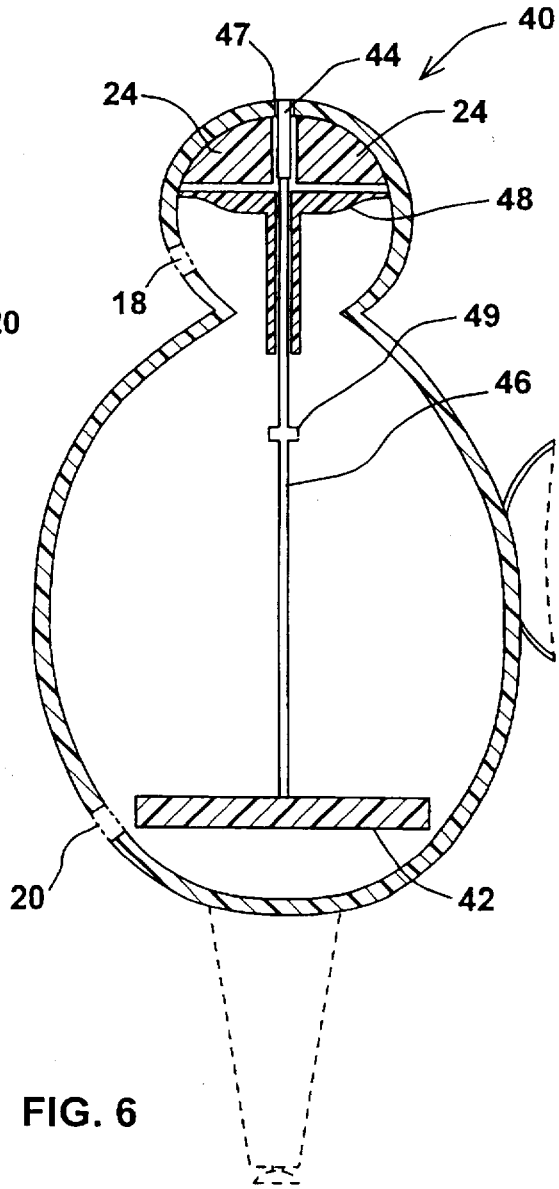
FIG. 6 is a schematic side cross-sectional view of the embodiment of FIG. 5.

Turning now to FIGS. 5 and 6, these show a preferred embodiment of a variable buoyancy amusement device, generally designated 40, constructed and operative according to the teachings of the present invention. Generally speaking, device 40 is similar to device 10, and equivalent elements are labeled similarly. Device 40 includes additional elements for deploying one or more externally visible member in response to decreasing buoyancy of body 12.

Specifically, device 40 features a float 42 located within cavity 16, at least one member 44 movably mounted on body 12 so at to be deployable from a first position to a second position, and being externally visible in at least the second position. A mechanical linkage 46 links between float 42 and member 44 such that movement of the float caused by filling of cavity 16 with water actuates deployment of member 44 from the first to the second position.

In the example shown here, member 44 is a pop-up sign, typically bearing a verbal message such as, for example, "HELP!". In this case, mechanical linkage 46 is particularly simple, requiring little more than a single pin. A sealing washer 48 is provided to prevent leakage of air upwards from cavity 16, including around the pin. A stop 49, attached to linkage 46, limits the extent of movement of pop-up sign 44 so that it remains within a slot 47 formed in the surface of device 10. This structure ensures that pop-up sign 44 is held aligned with slot 47, and hence free to retract when water is subsequently emptied from cavity 16.

In this case, light upper portion 24 is shown as a pair of inserts of buoyant material such as, for example, expanded polystyrene foam. The inserts are arranged so as not to obstruct movement of member 44.

Alternatively, member 44 may be implemented in a more complex manner, such as in the form of a pair of arms or other limbs which are pivotally mounted on body 12. In such a case, mechanical linkage 46 includes levers mounted within body 12 for deploying the arms.

Clearly, device 40 provides an added element of excitement in the sinking process of body 12.

It will be appreciated that the above descriptions are intended only to serve as examples, and that many other embodiments are possible within the spirit and the scope of the present invention.

What is claimed is:

1. A variable buoyancy amusement device for use in water, the device comprising a body having a water-impermeable outer surface and an internal volume, said body including:

(a) a lower portion having a local density significantly greater than that of water such that said body tends to assume an upright orientation with said lower portion at the underside of said body;

(b) an internal cavity having an upper part and a lower part defined by their positions when said body assumes said upright orientation;

(c) an shaped upper aperture connecting between said upper part of said cavity and an adjacent point on said surface; and (d) a lower aperture connecting between said lower part of said cavity and an adjacent point on said surface, said lower aperture being shaped similarly to said upper aperture, wherein said upper and lower apertures are selectively sealable such that, when said cavity contains air and any one of said apertures is sealed said body floats on the water with said lower aperture submerged and, when both of said apertures are open, water enters said cavity through said lower aperture thereby reducing the buoyancy of said body and causing it to sink.

2. A device as in claim 1, wherein said body further includes a light upper portion having a local density significantly less than that of water such that said body is self-righting to said upright orientation when submerged.

3. A device as in claim 1, further comprising a complementary plug shaped to complement said shaped upper aperture and employable selectively for sealing either one of said upper and lower apertures.

4. A device as in claim 3, wherein said upper and lower apertures are implemented as apertures of area less than about 4 $cm^2$.

5. A device as in claim 1, further comprising an input tube having a first end adapted for sealable connection to one of said upper and lower apertures for introducing air into said cavity.

6. A device as in claim 1, wherein said lower portion provides a substantially flat resting surface for said body.

7. A device as in claim 1, wherein said body is implemented in the form of a doll.

8. A device as in claim 1, further comprising:

(a) a float located within said cavity;

(b) at least one member associated with said body, said member being deployable from a first position to a second position, said member being externally visible in at least said second position; and (c) a mechanical linkage linking between said float and said member such that movement of said float caused by filling of said cavity with water actuates deployment of said member from said first position to said second position.

9. A device as in claim 8, wherein said at least one member includes a pop-up sign.

* * * * *